United States Patent [19]

Frost et al.

[11] 3,980,033

[45] Sept. 14, 1976

[54] PLACKET BUTTONHOLE SYSTEM

[75] Inventors: Walter Wade Frost, Vidalia; John P. Hunter, Jr., Dunwoody, both of Ga.

[73] Assignee: Oxford Industries, Inc., Atlanta, Ga.

[22] Filed: Apr. 28, 1975

[21] Appl. No.: 572,269

[52] U.S. Cl. ..... 112/264; 112/65; 112/121.15; 112/121.27; 112/203

[51] Int. Cl.[2] ..... D05B 3/06; D05B 21/00; D05B 27/00

[58] Field of Search ..... 112/264, 262, 121.11, 112/121.15, 121.27, 121.29, 65, 66, 203, 205

[56] References Cited

UNITED STATES PATENTS

| | | | |
|---|---|---|---|
| 1,722,658 | 7/1921 | Busha | 112/264 X |
| 3,515,081 | 6/1970 | Miller | 112/121.27 X |
| 3,611,961 | 10/1971 | Lopez et al. | 112/121.11 |
| 3,780,682 | 12/1973 | Frost | 112/262 |
| 3,879,029 | 4/1975 | Cruden | 112/65 |
| 3,884,166 | 5/1975 | Rinehimer et al. | 112/121.29 |

*Primary Examiner*—H. Hampton Hunter
*Attorney, Agent, or Firm*—Jones, Thomas & Askew

[57] ABSTRACT

A system for manufacturing curved shirt plackets with buttonholes includes the steps of moving curved placket blanks in sequence from the top of a bundle to a positioning station, positioning the plackets for feeding to a buttonhole sewing machine, intermittently feeding the plackets to a buttonhole sewing machine and turning the plackets as necessary to align the lengths of the buttonholes across the length of the curved placket blanks, and transferring the plackets to a cutting station where they are cut in half and stacked in bundles of buttonhole halves and button halves.

11 Claims, 6 Drawing Figures

FIG 1
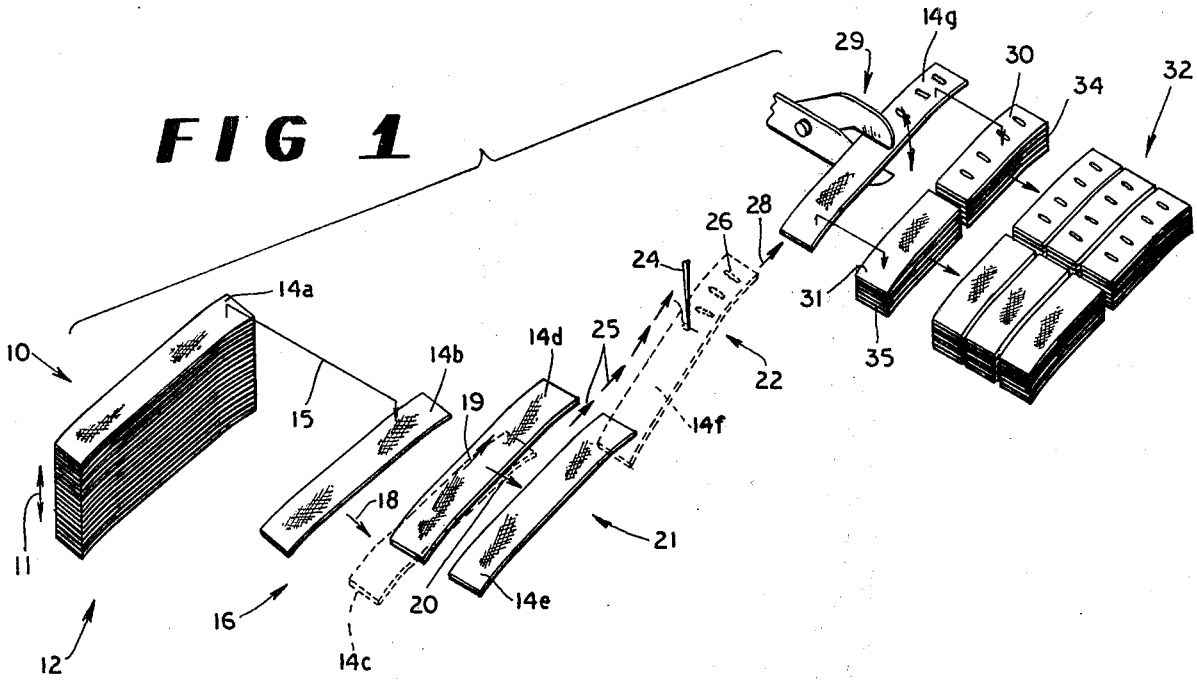
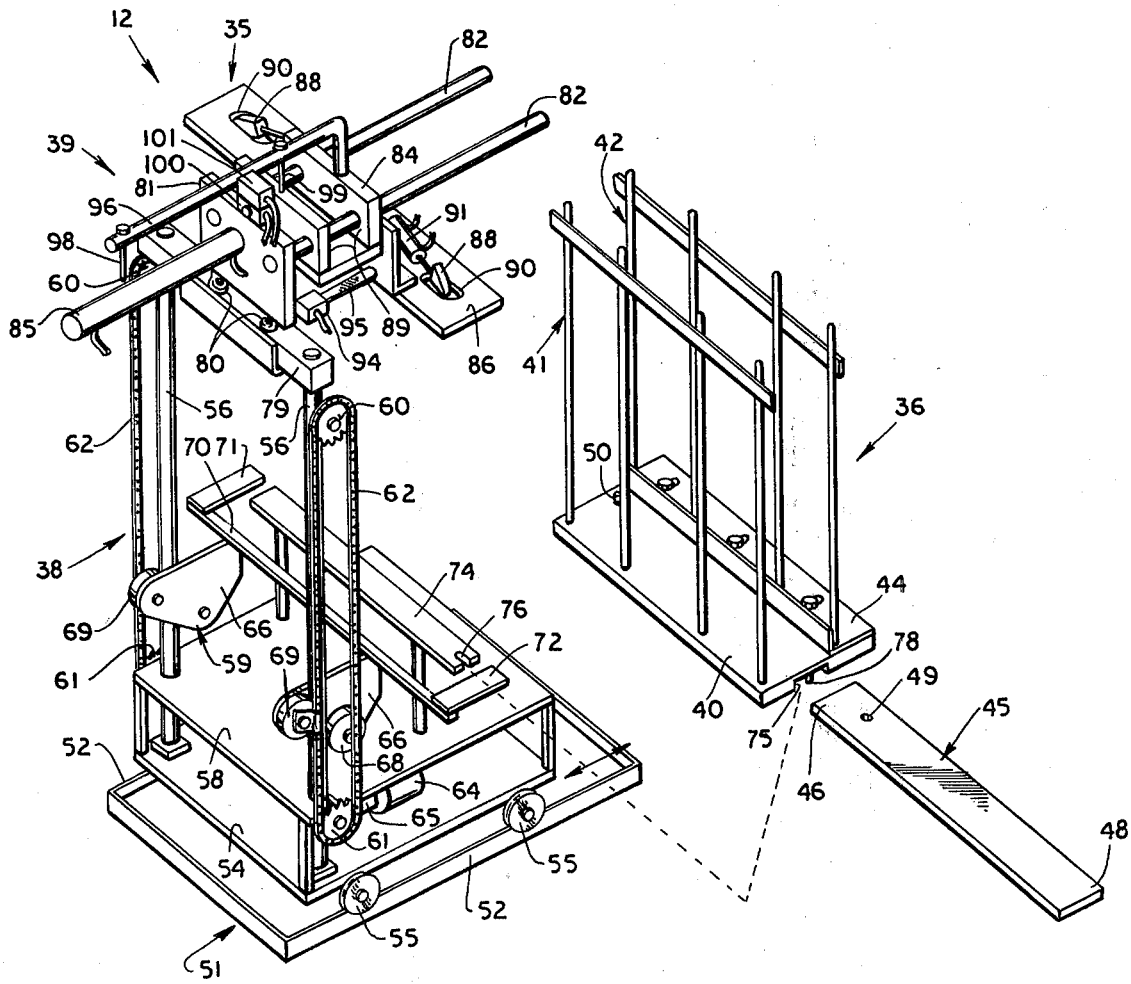
FIG 2

PLACKET BUTTONHOLE SYSTEM

BACKGROUND OF THE INVENTION

Certain styles of knitted shirts, blouses and other garments are formed with plackets having buttons and buttonholes at the front neck opening to facilitate donning and removal of the garment from the body and to form an attractive collar and placket design. In order to create a desirable and stylish garment, the placket must be perfectly formed with its buttonholes properly spaced and aligned with the length of the placket, preferably in alignment with the ribs in the knit of the placket. Some plackets are curved along their lengths, and the ribs in the knit formation are also slightly curved along the length of the placket, and it is desirable to form the buttonholes with their lengths extending approximately normal to the length of the placket and parallel to the ribs of the knit.

While it is desirable to have plackets virtually perfectly formed so as to create an attractive garment design, the relatively small plackets are difficult for a sewing machine operator to align in the sewing machine so as to form the buttonholes approximately normal to the length of the placket, and it is difficult for the sewing machine operator to space the buttonholes equally along the length of the placket. Moreover, the most experienced sewing machine operators are subject to the usual problems caused by fatigue and frequently make errors in performing the required sewing functions to form the buttonholes in a placket. As a result, plackets are frequently improperly formed, resulting is an improperly formed garment which must be sold as a "second"or discarded.

While some attempts have been made to develop an automatic system for sewing buttonholes in shirt plackets, the attempts have been largely unsuccessful, mainly because of the difficulty in handling the highly flexible knitted placket and properly positioning the placket with respect to the buttonhole sewing machine, turning the placket in the sewing machine, and subsequently cutting the placket in half at the proper line of separation.

SUMMARY OF THE INVENTION

Briefly described, this invention comprises a system for forming buttonholes in shirt plackets, cutting the placket in half to form a buttonhole half and a button half, and stacking the halves in separate stacks. The placket blanks are taken in sequence from the top of a bundle of placket blanks, dropped onto a positioner where each placket blank is moved into the right location and placed in the right attitude for transferring to an indexer. The indexer moves the placket in intermediate steps through a buttonhole sewing machine, and the buttonhole sewing machine sews and cuts the buttonholes in one-half the length of the placket blank. The placket blank is curved along its length, and the indexer turns the placket in the sewing machine between the formation of the buttonholes so that the length of the buttonholes extend approximately normal to the curved length of the placket. When the last buttonhole has been formed in the placket, the placket is retrieved from the sewing station and moved to a cutting station where the placket is cut in half to form a buttonhole half and a button half. The placket halves are then moved from the cutting station to separate stacks of buttonhole halves and button halves, and the stacks are maintained adjacent each other until the system has completed a bundle of plackets, whereupon the stacked bundles of placket halves are shifted away from the stacking station to make room for a subsequent stacking operation.

Thus, it is an object of the present invention to provide a placket buttonhole system which functions automatically and accurately to form buttonholes in shirt front plackets and to cut the plackets in half to form buttonholes halves and button halves, and to stack the placket halves in an orderly and systematic manner for subsequent retrieval and processing.

Other objects, features and advantages of the present invention will become apparent upon reading the following specification, when taken in conjunction with the accompanying drawings.

BRIEF DESCRIPTION OF THE DRAWINGS

FIG. 1 is a schematic illustration of the movement of the plackets through the placket buttonhole system.

FIG. 2 is an exploded perspective view of the placket loader.

DETAILED DESCRIPTION

The System

Figure 3:
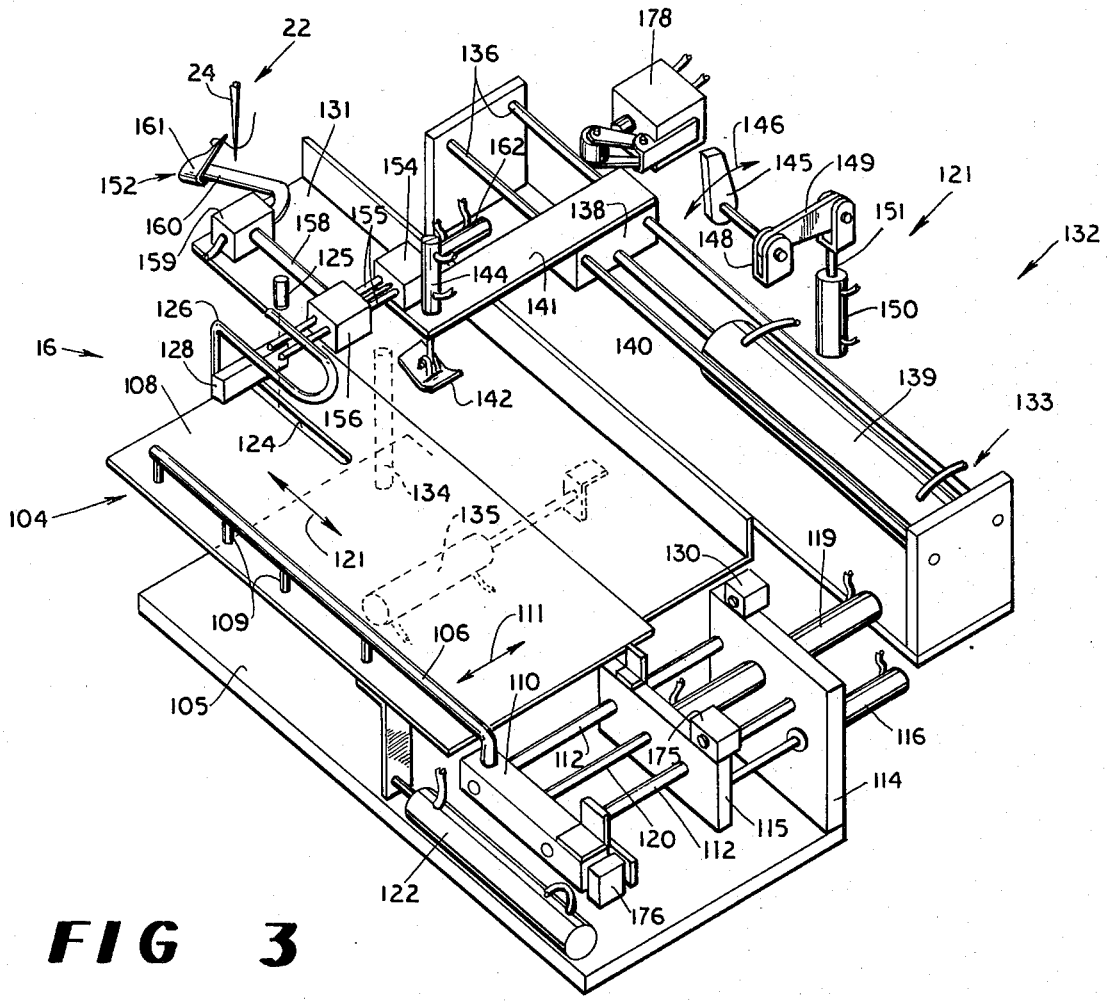
FIG. 3 is a perspective view of the placket positioner and the placket indexer.
Figure 4:
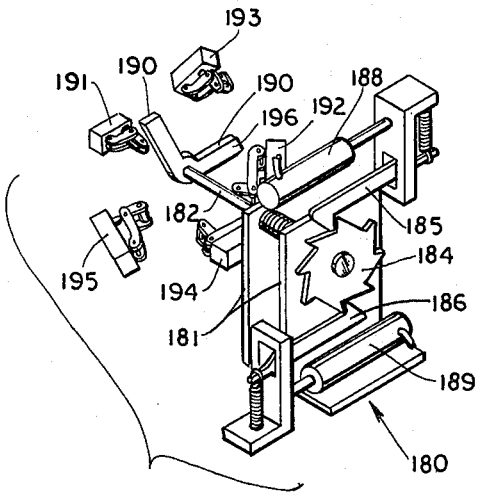
FIG. 4 is a partial schematic illustration of the programmer for the placket indexer.

Referring now in more detail to the drawing, wherein like numerals indicate like parts throughout the several views, FIG. 1 illustrates in schematic form the various positions of the plackets as they are processed in sequence through the placket buttonhole system. A bundle 10 of shirt front plackets are placed at a loading station 12, and the bundle 10 is moved up and down as illustrated by the arrow 11. The top placket **14*a* is retrieved from the bundle when the bundle is at the top of its movement, and the top placket is then transferred from the bundle as illustrated by arrow 15 to a positioning station 16. The placket 14*b* in the positioning station is then moved in the direction across its length as indicated by arrow 18 to a first intermediate position 14*c*. During the movement between positions 14*b* and 14*c* the placket is aligned or oriented so that its length is normal to its direction of movement 18. When the placket reaches the first intermediate position as illustrated in dashed lines at 14*c*, the placket is then moved in the direction indicated by arrow 19 along its length to the second intermediate position 14*d*, whereupon the placket has been oriented and is now properly positioned for movement in the direction indicated by arrow 20 to indexing station 21. The movement to indexing station 21 is in a direction normal to the length of the placket, and when the placket 14*e* reaches indexing station 21, it will be in alignment with sewing station 22 and its leading end will be at a predetermined distance from the needle 24 of the sewing machine. The placket is then indexed or advanced in intermittent steps from position 14*e* through the sewing station as indicated in dashed lines at position 14*f* and as indicated by the arrows 25. The placket is turned in the indexing station after the second buttonhole 26** has been sewn so that the length of the buttonholes will be oriented normal to the curved length of the placket.

After the last buttonhole 26 has been sewn, the placket is advanced in the direction indicated by arrow 28 to the cutting station 29 as indicated by placket 14*g*, whereupon the placket is cut in half to form a buttonhole half 30 and a button half 31. The placket halves are moved from the cutting station to the stacking station 32 where they are stacked in separate stacks of buttonhole halves 34 and stacks of button halves 35. After the entire bundle 10 has been processed through the system so as to form a completed bundle of buttonhole halves and button halves, the bundles are then shifted in a direction across their lengths out of the reach of the stacker.

Loader

As is illustrated in FIG. 2, loader 35 is located at the loading station of the system and includes a rack 36, an elevator 38, and a feeder 39. Rack 36 comprises a horizontal base 40 with two rows 41 and 42 of upright stanchions located on opposite sides of its upper surface. The row 42 of stanchions is mounted on an adjustable support 44 that is movable across the width of the horizontal base 40, while the row of stanchions 41 are permanently mounted in the horizontal base. With this arrangement the row of stanchions 42 is adjustably movable toward or away from the row of stanchions 41. The rack 36 is therefore open at its opposite ends and at its top so as to form a cage or guiding apparatus for a bundle of shirt front plackets.

A tray 45 is of a length longer than the length of the rack 36 and of the width smaller than the space between the rows of stanchions 41 and 42, so that it is movable into the rack and rests upon the horizontal base 40 with its end portions 46 and 48 protruding beyond the opened ends of the racks 36. A pinhole 49 is defined in the tray 45, and a mating pin 50 protrudes upwardly from the horizontal base 40 of the rack 36, so that when the tray 45 is placed in the rack 36, the pin 50 and pinhole 49 will mate so as to properly position the tray in the rack.

Elevator 38 is mounted on a framework 51 which includes parallel support rails 52. The elevator includes base 54 that has wheels 55 engaging the rails 52, stanchions 56 mounted on base 54 and extending upright from the base, and raised platform 58 spaced above base 54. The stanchions 56 function as a guide means for a trolley 59, and vertically spaced sprockets 60 and 61 are supported by each stanchion 56 and elevator chains 62 are trained around the sprockets 60 and 61. A reversible air motor 64 with a brake attachment (not shown) and transmission 65 are located between base 54 and platform 58 of the elevator 38 and function to rotate the lower sprockets 61.

Trolley 59 is mounted on the upright stanchions 56 and includes a pair of wheel supports 66 each including a pair of rollers 68 and 69 that engage the stanchions on opposite sides of the stanchions and at different elevations. A fork lift frame 70 is mounted on the wheel supports 66 and includes fork projections 71 and 72. A rack support 74 is mounted on raised platform 58. The horizontal base 40 of rack 36 includes a rectilinear cutout 75 in its bottom surface that is of a width slightly larger than the width of rack support 74, so that the rack 36 can be placed on the rack support 74 and slid along the length of the rack support. The rack support 74 includes a detent 76 at one of its ends, and the base 40 of the rack includes a projection 78 at one of its ends, and the detent 76 and projection 78 are located with respect to the rack support 74 and the rack 36 so that the projection 78 will slide into the detent 76 so as to properly locate the rack 36 with respect to the rack support 74 and the elevator 38.

When the rack 36 is loaded into the elevator 38, the projections 71 and 72 of the fork lift 70 will be located just beyond the ends of the rack 36, and the ends 46 and 48 of the tray 45 will project beyond the ends of the rack and will extend over the projections 71 and 72 of the fork lift frame 70. Thus, when elevator 38 causes its trolley 59 to move in an upward direction, the fork lift 70 will engage the ends 46 and 48 of the tray 45 and lift the tray in an upward direction with respect to rack 36. If a bundle of shirt plackets has been loaded in the rack 36, the tray 45 will elevate the bundle.

Feeder 39 is mounted on the upper end of loader 35. Feeder support 79 is mounted on the upper ends of stanchions 56, and eye bolts 80 pivotally mount the feeder 39 on the feeder support 79. Feeder 39 includes pivotal support block 81, guide rods 82 extending laterally from the support block 81, carriage 84, ram 85, shedder plate 86, and pickup fingers 88. Carriage 84 includes a pair of spaced plates 89 with apertures that are fitted about the guide rods 82, so that the carriage is movable back and forth along the lengths of the guide rods. Ram 85 is mounted on the pivotal support block 81 and its ramrod (not shown) extends through the pivotal support block and is connected to the carriage 84 so as to move the carriage along the lengths of the guide rods. Shedder plate 86 is supported by the carriage 84 at a level below the guide rods 82, and the shedder plate defines openings 90 through which the pickup fingers 88 can reciprocate. The movements of the pickup fingers 88 are controlled by the rams 91, and the pickup fingers 88 each include pins (not shown) which protrude a distance from the fingers that is equal to slightly less than a thickness of a shirt placket. The rams 91 move the pickup fingers in oppositely downwardly inclined directions through the openings 90 in the shedder plate.

The movements of the loader 35 are powered by compressed air and controlled by air valves. An upper limit valve 94 is mounted on pivotal support block 81 of the feeder and its valve lever 95 extends over to the shedder plate 86. The shedder plate 86 is illustrated in its retracted position where it is located vertically above the rack 36 when the rack is properly positioned in the elevator 38. When elevator 38 is operated so as to lift tray 45 and the bundle of shirt plackets resting on the tray in an upward direction in rack 36, the top placket on the bundle will engage the shedder plate 86 and the lever 95 of the upper limit valve 94. When the valve 94 is actuated, it stops the elevator motor, temporarily applies the brake of the elevator motor, and reverses the elevator motor for a short time duration. In the meantime, the rams 91 of the pickup fingers 88 extend the pickup fingers in oppositely downwardly inclined directions through the openings 90 in the shedder plate 86, so that the pin protrusions of the pickup fingers engage the top shirt placket and hold or grasp the top placket. When the elevator motor has been reversed to depress the bundle, the pickup fingers will hold the top placket at the shedder plate while the bundle moves in a downward direction away from the top placket. The upper limit valve 94 actuates ram 85 to move the carriage 84 along the guide rods 82 from above the bundle; however, the actuation of ram 85 is subject to two conditions, one condition being the actuation of the upper limit valve as previously described, and the other condition is the closing of the home position valve 176 of the positioner 104 which will be subsequently described.

A valve actuator 96 is mounted on carriage 84 and includes downwardly extending protrusions 98 and 99. A pair of oppositely facing valves 100 and 101 are mounted on the pivot support block 81 and the valve actuator 96 extends over the valve and its protrusions 98 and 99 engage and actuate the valves.

When ram 85 distends to move carriage 84 outwardly along guide rods 82 so as to move the shedder plate 86 from vertically above the rack 36 in a lateral direction, valve actuator 96 will move the carriage and its protrusion 98 will engage valve 100 when the carriage reaches the end of its outward lateral movement. Valve 100 therefore functions as the extended position valve and causes the rams 91 of the pickup fingers 88 to retract the pickup fingers, causing the pickup fingers to move in upwardly inwardly inclined directions back through the openings 90 of the shedder plate, causing the pin protrusions of the pickup fingers to release the shirt placket and drop the shirt placket. Also, the extended position valve 100 causes ram 85 to reverse and pull carriage 84 back along its guide rods 82 toward its home position. When the carriage approaches its home position, the protrusion 99 of the valve actuator 96 engages home position valve 101, which causes elevator 30 to begin its upward movement again so that the motor 35 will start its next cycle of operation.

Positioner

As is illustrated in FIG. 3, the placket positioner 104 is located at positioning station 16 and includes a support platform 105, positioning rod or bar 106 and positioning platform or tray 108. Positioning rod 106 is rectilinear and includes a plurality of downwardly extending leg elements 109 that terminate in juxtaposition with the top surface of positioning tray 108. Positioning rod 106 is supported in a cantilever arrangement from its movable support block 110 which functions to move the positioning rod across the positioning tray 108 in the directions indicated by the double headed arrow 111.

A pair of guide rods 112 are supported by stationary support block 114, and movable support block 110 as well as intermediate movable support block 115 are slidably movable along the lengths of guide rods 112. Ram 116 is mounted in stationary support block 114 and its ramrod 118 is connected to intermediate movable support block 115 and functions to reciprocate the support block 115 along the guide rods 112. Movable ram 119 is mounted on and is movable with intermediate movable support block 115, and its ramrod 120 is connected to movable support block 110 and functions to move the movable support block 110 along the lengths of guide rods 112, toward and away from the intermediate movable support block 115.

Positioning tray 108 is movably mounted on support platform 105 and is movable in the directions as indicated by the double headed arrow 121. Positioning the tray ram 122 is mounted on base 105 and its ramrod is connected to the positioning tray 108 and functions to reciprocate the tray as indicated by arrow 121. An elongated slot 124 is defined in the positioning tray 108, and a photoelectric cell 125 is supported by a curved support rod 126 above the positioning tray 108 for detecting the presence of absence of light through the slot 124. A placket stop element 128 is located at the edge of positioning tray 108 over slot 124 and is in juxtaposition with the upper surface of the positioning tray.

When the extended position valve 100 of the loader 35 is actuated and the loader drops a placket onto the positioning tray 108. The actuation of the extended position valve 100 at the loader causes ram 116 to move movable intermediate support block 115 toward the stationary support block 114, which carries the movable support block 110 and the positioning rod 106 from the position illustrated to a position approximately one-half the distance across the positioning tray 108, which results in the leg elements 109 of the positioning rod to engage and move the shirt placket from the position where it was dropped on the positioning tray to a first intermediate position that is in alignment with the slot 124 of the tray. When the positioning rod 106 reaches this intermediate position, the movable intermediate support block 115 engages and actuates the first position valve 130. First position valve 130 actuates positioning tray ram 122, which causes the positioning tray 108 to move beneath the stationary placket stop 128. This causes the placket to be carried by the positioning tray 108 toward the placket stop 128. As the placket approaches placket stop 128, photoelectric cell 125 detects the movement of the placket toward the placket stop, and as the tray continues its movement beneath the placket stop 128, the leading end of the placket eventually engages the placket stop and stops. The positioning tray 108 may continue to move for some distance after the leading end of the placket first engages the placket stop 128, but the surface of the positioning tray 108 is substantially smooth so that the positioning tray will then slide beneath the placket and not force the placket to continue its movement.

After the photoelectric cell 125 detects the movement of the placket toward the placket stop 128, a short time delay occurs to allow the placket to continue its movement on the positioning tray until the placket reaches placket stop 138, and if the home position valve 191 of the programmer 180 is engaged, as will be explained later, the movable ram 119 is actuated, causing movable support block 110 to move toward movable intermediate support block 115. This moves the positioning rod 106 further across positioning tray 108, and the leg elements 109 again engage the placket and sweep the placket in a direction normal to its length off the positioning tray 108 and onto the indexing tray 131 of the indexer 132 at indexing station 21.

Indexer

The indexer 132 at indexing station 21 includes indexing tray 131 and its control system 133. Indexing tray 131 is mounted from base 105 of positioner 104 by means of pivotal stanchion 134 (illustrated in dashed lines), an indexing tray 131 as well as its control system 133 is pivotal on the stanchion with respect to base 105. Ram 135 is mounted on base 105 and functions to pivot indexing tray 131 and its control system 133 with respect to base 105.

A pair of guide rods 136 are mounted in a horizontal plate adjacent indexing tray 131, and carrier 138 is slidably mounted on the guide rods 136. Carrier ram 139 has its ramrod 140 connected to the carrier 138 and functions to reciprocate the carrier 138 along the guide rods 136. Carrier 138 includes a support plate 141 that extends laterally from the carrier over indexing tray 131, and placket engaging foot 142 is supported by support plate 141, and foot ram 144 is mounted on the support plate and functions to reciprocate the placket engaging foot 142 toward and away from indexing tray 131.

A carrier limiter 145 is positioned adjacent guide rods 136 and carrier 138 and is pivotal as indicated by arrow 146 into and out of the path of carrier 138, so as to limit the distance that the carrier can move along the guide rods 136. Carrier limiter 145 includes a support clevis 148, actuating lever 149, and ram 150. When the ramrod 151 distends to oscillate the link 149 upwardly, the carrier limiter 145 will move in a counterclockwise direction over into the path of carrier 138, and the carrier cannot move beyond the position of carrier limiter 145.

FIG. 3 illustrates the sewing machine needle 24 which is located in the sewing station 22, and thread wiper 152 is movable through the sewing station 22 beneath needle 24 when the needle is up. Thread wiper 152 is mounted on support plate 141 of carrier 138 and includes support block 154, guide rods 155 extending laterally from the support block 154, sliding block 156 slidable along the length of the guide rods 155, support bar 158, mounting block 159, wiper rod 160, and wiper finger 161. The thread wiper 152 is movable with the movement of carrier 138 along the length of indexing tray 131, and the system is timed so that the wiping finger 161 moves from the infeed side beneath the needle 24 to the outfeed side of the sewing machine when the sewing machine is at rest and the needle is in its up position. When the wiper finger 161 is to move from the outfeed side of the sewing machine back to the infeed side of the sewing machine, the sewing machine is in operation with its needle 24 reciprocating, so that the wiper finger 161 must be moved around the needle. Wiper ram 162 is mounted on support block 154 and is arranged to reciprocate sliding block 156 along guide rods 155, so that when wiper finger 161 is to be moved from the outfeed side back to the infeed side of the sewing station, the ram 162 distends its slide block 156 along guide rods 155, thus moving the guide finger 161 out of the path of the needle 24 of the sewing machine.

Figure 5:
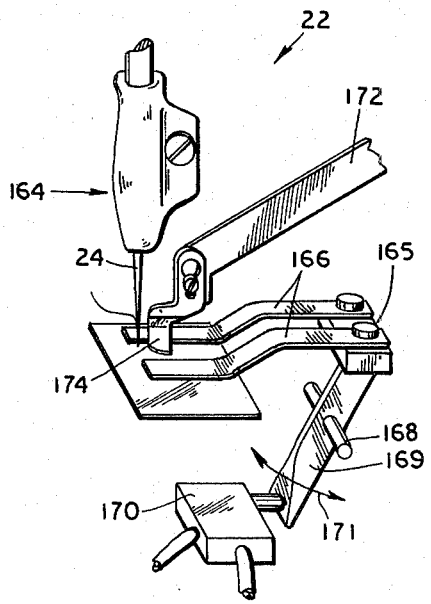
FIG. 5 is a detail illustration of the buttonhole sewing machine with its hole cutter and valve system.

As is illustrated in FIG. 5, the buttonhole sewing machine 164 at the sewing station 22 includes a clamp 165 that includes a pair of clamp fingers 166 that are pivotal about a pivot pin 168 in the base of the sewing machine (not shown), so that the clamp fingers 166 are movable toward clamping relationship with the working surface of the sewing machine to hold the work piece in a stationary position beneath the needle 24 of the sewing machine. The clamp 165 includes a lever 169 that extends to a position adjacent sewing machine valve 170, so that the arcuate movement of the lower end of lever 169 indicated by arrow 171 functions to open and close valve 170 as the clamp 165 moves up and down against the working surface of the sewing machine. Buttonhole cutter 172 is located above the working surface of the sewing machine and includes a cutter blade 74 that is arranged to pulse with a chopping stroke in a downward direction through the work piece between the binding of the buttonhole, to form the hole of the buttonhole. The sewing machine, buttonhole cutter and clamp are conventional in the art, and form no significate part of the present invention; but valve 170 in the base of the sewing machine comprises a part of the control system of the invention, as described hereinafter.

When positioning rod 106 of positioner 104 is moved from its first position to its fully extended position across positioning tray 108, the movable support block 110 engages the extended position valve 175. The indexer extended position valve 175 reverses both rams 116 and 119 of the positioner and ram 122 which controls the positioning tray, causing the positioning rod 106 to return to its home position as illustrated, whereupon the movable support block 110 engages home position valve 176. When the home position valve 176 is engaged, this signals the loader 12 that the positioner 104 is ready to receive the next placket, and if the loader 12 has returned to its start position and its home position valve 101 has been actuated, the loader will begin its next cycle.

When the fully extended position valve 175 of the positioner 104 is engaged, the positioning rod 106 will have swept the shirt placket off the positioning tray 108 onto the indexing tray 131, and the shirt placket is properly oriented and located on the indexing tray to begin the subsequent steps of indexing and sewing. The engagement of fully extended position valve 175 signals the indexer to start its function, causing the foot ram 144 of the placket engaging foot 142 to move the foot 142 in a downward direction toward engagement with the placket on the indexing tray 131, and carrier ram 139 is distended to move carrier 138 along guide rods 136 from a position adjacent the ram 139 toward a fully distended position. As the carrier moves along the guide rod, the placket engaging foot 142 urges the placket on the indexing tray 131 toward the sewing station 22 and beneath sewing machine needle 24. When the carrier 138 reaches its fully distended position, it engages indexer reverser valve 178. When indexer reverser valve is actuated by the carrier 138, carrier ram 139 reverses to move the carrier back toward its home or retracted position, foot ram 144 retracts placket engaging foot 142, wiper ram 162 distends thread wiper 152 so that the wiping finger 161 moves out of the path of the sewing machine needle 24, and the operation of the sewing machine 164 begins.

When the sewing machine 164 is actuated in the manner described, its clamp 165 moves down into engagement with the work piece and holds the work piece in a stationary position while the sewing machine functions to sew the buttonhole. When the buttonhole has been completed, the hole cutter 172 forms tis hold between the hem of the buttonhole, and upon the completion of this, the clamp 165 releases the work piece. The lever 169 of the clamp 165 engages valve 170 when the clamp 165 releases the work piece. Sewing machine valve 170 signals the carrier ram 139 to begin its next cycle of movement.

Programmer 180 is located beneath base 105 of the positioner 104 and functions to correlate the movements of the indexer. Programmer 180 includes a pair of support plates 181, a ratchet wheel shaft 182 rotatably supported by the support plate 181, a ratchet wheel 184 mounted on one end of the ratchet wheel shaft 182, a ratchet wheel actuating pawl 185 engaging one portion of the ratchet wheel 184 and a holding pawl 186 engaging another portion of the ratchet wheel 184. The actuating pawl 185 is reciprocated by its ram 188 while holding pawl 186 is reciprocated by its ram 189. An L-shaped valve actuator 190 is mounted on the ratchet wheel shaft 182, and a plurality of valves 191–195 are located in the path of movement of the L-shaped valve actuator. Valve 191 is the home position valve, valve 192 is the first position valve, valve 193 is the second position valve, valve 194 is the third position valve, and valve 195 is the fourth position valve. Each time the indexer reverser valve 178 of indexer 132 is engaged by carrier 138, actuating pawl 185 is moved by its ram 188 to rotate the ratchet wheel 184 in a clockwise direction a distance sufficient to cause the L-shaped valve actuator 190 to move its leg 196 into engagement with one of the valves 192–195. When the indexer reverser valve is engaged upon the first cycle of operation of the indexer, the L-shaped valve actuator is moved out of engagement with its home position valve 191 and into engagement with first position valve 192. First position valve 192 distends carrier limiter ram 150 to rotate the carrier limiter 145 in a counterclockwise direction so that the carrier limiter is moved into the path of the carrier 138 and limits the distance that the carrier 138 can move back toward its home position.

When the sewing machine has completed its function of sewing and cutting the first buttonhole, the needle 24 and clamp 165 of the sewing machine will be raised and the sewing valve 170 will begin the next cycle of operation of the indexer, which causes the carrier ram 139 to distend and move the carrier 138 from its halfway position to its fully distended position, and the placket engaging foot 142 again moves down into engagement with the placket so as to urge the placket through the sewing station. When the carrier 138 reaches its fully distended position, the indexer reverser valve 178 is again engaged, causing the placket engaging foot 142 to retract, the thread wiper 152 to be distended out beside the sewing machine needle 124 so that it will move back around from the outfeed side to the infeed side of the sewing machine, and the carrier ram 139 to reverse. Also, indexer reverser valve 178 causes actuating pawl 185 to the programmer to move the ratchet wheel 184 again, causing the L-shaped valve actuator to rotate and have its arm 198 engage the second position valve 193. The second position valve 193 maintains the carrier limiter 145 in its already pivoted position so that it continues to limit the rearward movement of the carrier 138, and in addition, second position switch 193, after a short time delay, actuates indexing tray ram 135 which causes the indexing tray to pivot about its support stanchion 134 and turn the placket beneath the needle 24 of the sewing machine. The time delay between the actuation of the second position switch 193 of the programmer and the beginning of the turning of the placket is sufficient to allow the sewing machine to complete the sewing and cutting of the second buttonhole in the placket.

When the sewing machine completes the second buttonhole, the sewing machine valve 170 signals ready for the next cycle of the indexer, and when the timer has timed out and the connecting tray 131 has completed its pivoting movement to turn the work piece in the sewing station, the carrier 138 is again moved by its carrier ram 139 and the placket engaging foot 142 again engages the placket and the placket is moved further through the sewing station to reposition the placket for its third buttonhole. When the indexer reverser valve 178 is engaged for the third time, the L-shaped switch actuator 190 is again rotated in a clockwise direction by ratchet wheel 184 and the third position valve 194 of the programmer is engaged by arm 196 of the L-shaped valve actuator, which keeps the carrier limiter 145 in its limiting position an keeps the indexing tray 131 in its pivoted position.

When the buttonhole sewing machine completes a third buttonhole, the indexer moves the placket further into the sewing station, and the sewing machine cycle repeats to form the fourth buttonhole. When the indexer reverser valve 178 is engaged for the fourth time, the L-shaped valve actuator 190 engages the fourth position valve 195, whereupon the holding pawl 186 is moved by its ram 189 out of engagement with the ratchet 184, and when the sewing machine completes the fourth buttonhole and actuates the sewing machine valve 170, the actuating pawl 185 will also move beyond engagement with the ratchet wheel 184. This removes both pawls 185 and 186 out of engagement with the ratchet wheel 184, so that the torsion spring 185 rotates the ratchet wheel 184 and its L-shaped valve actuator 190 back to its original position where it engages the home position valve 191. When the fourth position valve 195 is disengaged, the carrier limiter 145 is pivoted out of the path of carrier 138, thus allowing the carrier to move to its fully retracted position, and ram 135 of the indexing tray 131 is retracted to pivot the indexing tray back to its original position where it is in juxtaposition with the positioning tray 108. Home position valve 141 signals the positioner 104 that the indexer 132 is ready to accept the next placket.

The sewing machine 164 functions to cut the thread extending from the needle to the previously sewn buttonhole; however, the thread is cut beneath the surface of the shirt placket so that the thread still extends through the material. If the indexer urged a shirt placket on through the sewing station without thread wiper 152, the thread extending from the needle into the shirt placket might tend to cause the shirt placket to curl up and jam the sewing machine. The thread wiper 152 positively moves the thread extending from the sewing machine needle along with the shirt placket, therefore preventing any curling of the shirt placket. The thread eventually pulls out of the shirt placket as the operation of the machine resumes.

Transfer and Cut

Figure 6:
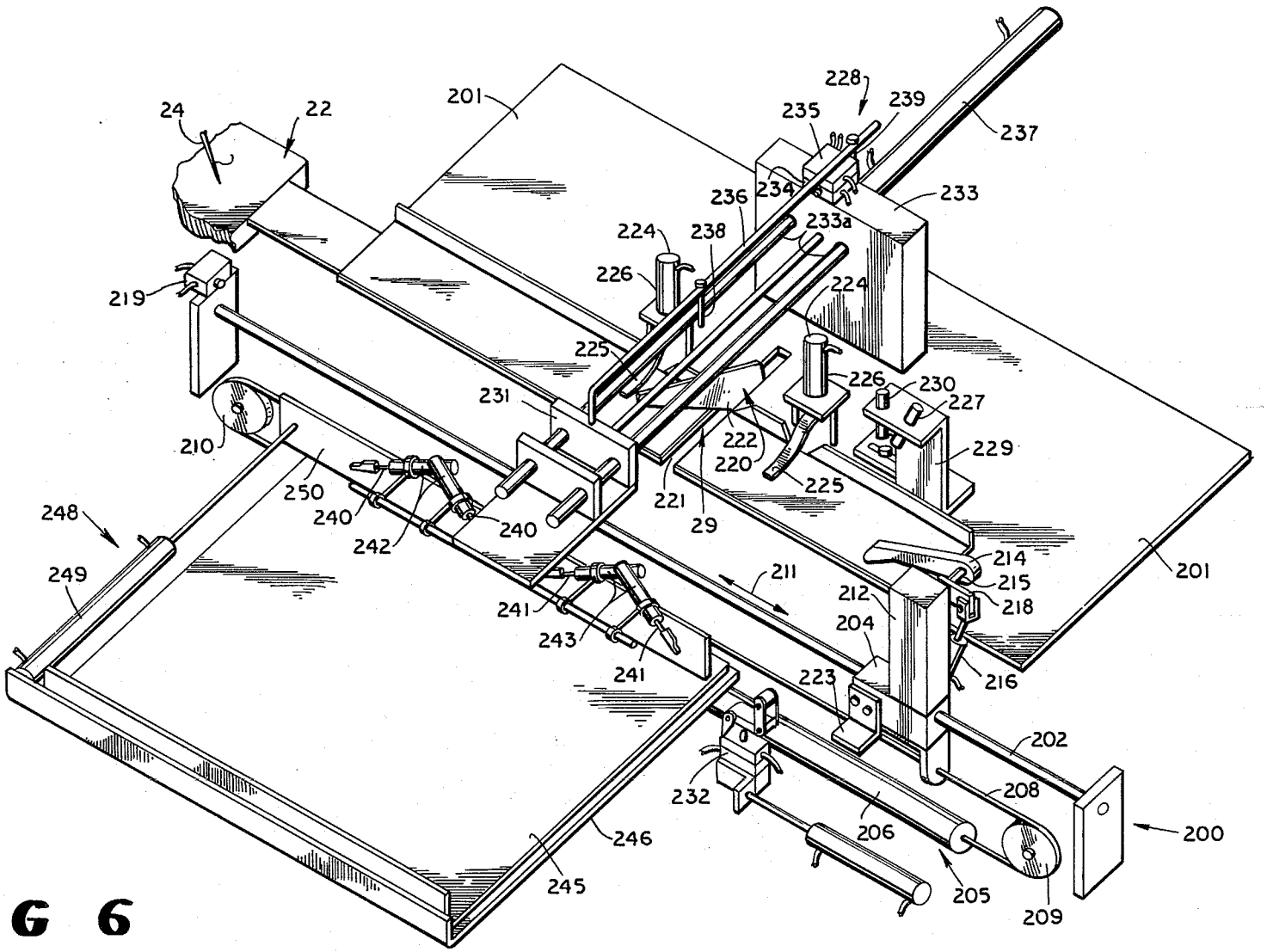
FIG. 6 is a perspective view of the transfer apparatus, cutter, stacker, stacking tray and bundle shifter.

As is illustrated in FIG. 6, a transfer apparatus 200 is located adjacent the outfeed side of the sewing station 22 and includes a work table 201, a guide rod 202, a carrier 204 mounted on the guide rod 202, and a driven system 205. The drive system 205 includes a ram 206 having a wire 208 extending about a pair of spaced apart pulleys 209 and 210, with the wire 208 being connected to carrier 204. The drive system 205 functions to move the carrier back and forth along the guide rod in the directions indicated by the double headed arrow 211. A support block 212 is mounted on carrier 204 and extends up adjacent the work table 201. A placket wiper 214 is mounted on a horizontally extending support rod 215 which is rotatably mounted in support block 212, and placket wiper ram 216 is supported on support block 212 and is connected to support rod 215 by means of link 218 and functions to oscillate placket wiper 214 toward and away from the work table 201. Reversing valve 219 is located adjacent sewing station 22 at the end of the movement of carrier 204 along guide rod 202.

Cutter 220 is located on work table 201. A slot 221 is formed in the work table, and a cutting blade 222 is movable with respect to the slot 221 in a scissors action to cut the work piece extending across the slot 221. The cutting blade 222 is actuated by a ram (not shown) that is located beneath the work table. A pair of placket clamps 224 are mounted on the work table 201 on opposite sides of slot 221. Each placket clamp 224 includes a clamp element 225 and an actuating ram 226 that moves the clamp element 225 toward and away from the work table 201. A photoelectric cell 227 is mounted in a bracket 229 adjacent the path of travel of the plackets across the work table 201, and a source of light 230 is mounted above the table so as to create a light spot in the path of the plackets. When the light spot is covered by a placket, the photoelectric cell 227 will detect the presence of the placket on the work table.

When the second position valve 193 of the programmer 180 is actuated by the L-shaped valve actuator 190, the drive system 205 of the transfer apparatus 200 moves the carrier 204 toward the sewing station 22, so that the carrier will be in proper position to receive the placket when the last buttonhole has been formed in the placket. When the carrier 204 reaches the sewing station it engages the carrier reversing valve 219 which would cause the carrier to move back to its home position; however, the carrier will not begin its home movement until the fourth position valve 195 of the programmer 180 is actuated. When the fourth position valve is actuated in the programmer, the placket wiper 214 is oscillated to its down position by its ram 216 so that the placket wiper engages the placket at the sewing station, and the drive system 205 begins to move carrier 204 away from the sewing station 22 back to the home position. The movement of the carrier is relatively fast so that the placket can be moved out of the sewing station rapidly, and as the carrier approaches its home position, a protrusion 223 on the carrier engages slow down valve 232 which is located adjacent the path of the carrier. Slow down valve 232 functions to restrict the escape of air from the drive system 205, causing the carrier to decelerate and move at a relatively slow speed. As the carrier continues to pull the shirt placket on into the cutting station 28, the photoelectric cell 227 detects the leading edge of the placket and raises the placket wiper 214 to terminate any further movement of the placket and actuates the ram (not shown) of cutting blade 222 and the rams 226 of the placket clamps 224. The cutting blade 222 thereupon cuts the placket in half with a scissors action while the clamps 224 move their clamping elements 225 down into engagement with the placket on opposite sides of the cutting blade 222 so as to hold the placket as it is being cut. The cutting blade 222 and clamps 224 pulse and then return to their ready positions.

Stacker

Stacker 228 is mounted over work table 201 and includes a support block 233, guide rods **233*a* mounted in the support block 223, carrier 231 slidably mounted on the guide rods 233*a*, carrier ram 237 mounted on a support block 229 and arranged to reciprocate the carrier 231 on the guide rods 233*a*, and control valves 234 and 235 mounted on support block 229. A valve actuator 236 is mounted in a cantilever arrangement on carrier 231 and its protrusions 238 and 238 engage the valves 234 and 235. When the carrier 231 is moved back toward support block 229, it is in its home position and the protrusion 238 of the valve actuator 236 engages the home position valve 234. When the carrier is moved outwardly along the guide rods 233*a* by ram 237, it reaches its fully extended position and the protrusion 239 of the valve actuator 236 engages the extended position valve 235**.

Two pairs of pickup fingers 240 and 241 are mounted on carrier 231. The pickup fingers 240 and 241 are similar to the pickup fingers 88 of the loader 12, in that the pairs of rams 242 and 243 extend the pickup fingers 240 and 241 in downwardly oppositely inclined directions to engage the placket halves on the work table 201 that have been cut apart by the cutting blade 222. When the photoelectric cell 228 of the cutter detects the leading end of a placket, the stacker ram 237 brings the stacker back to its home position, and when the home position valve 234 detects the presence of the stacker in its home position, the pickup finger rams 242 and 243 are actuated to distend the pairs of pickup fingers 240 and 241, so that the downwardly oppositely inclined movements of the pairs of pickup fingers impale the placket halves. The home position valve reverses the stacker ram 237 and moves the stacker out to its extended position. A counter (not shown) is also actuated by the home position valve 234.

When the stacker reaches its extended position it engages its extended position valve 235, which retracts the pickup fingers to drop the placket halves. The stacker has now completed its function.

Bundle Shifter

The stacker drops the placket halves onto a stacking tray 245. The stacking tray 245 is supported by platform 246, and the stacking tray 245 can be manually removed from the platform, when desired. As the system continues to cycle, the original bundle 10 of plackets will be fed through the system and the entire bundle will finally be processed and stacked by the stacker on the stacking tray 245. When a bundle has accumulated on the stacking tray, it is desirable to shift the bundle out from beneath the delivery point of the stacker to make more room for more completed plackets. Bundle shifter 248 is mounted on platform 246 and includes ram 249 and shifting plate 250. The bundle shifter is dormant until the counter (not shown) is actuated by the stacker and reaches a preset number, whereupon the ram 249 retracts the shifting plate 250, thus pushing the completed bundles of placket halves out from beneath the delivery point of the stacker. The bundle shifter immediately returns to its illustrated position on the other side of the delivery point of the stacker so that another bundle can be accumulated on the stacking tray. The subsequent cycle of operation of the bundle shifter 248 causes the bundle shifter to push all of the previously accumulated bundles further over on the stacking tray. When the stacking tray is full, an operator can remove the stacking tray 245 from platform 246 and replace it with an empty stacking tray.

Control System

The control system illustrated and described herein is primarily a compressed air system with photoelectric cells used at positions in the path of movement of single plies of cloth to detect the presence of the cloth, such as cells 125 (FIG. 3) and 228 (FIG. 6); however, it will be understood by those having skill in the art that other control systems such as hydraulic or electrical control systems can be used if desired.

Moreover, while this invention has been described in detail with particular reference to the disclosed embodiment thereof, it will be understood that variations and modifications can be effected within the scope of the invention as described hereinbefore and as defined in the appended claims.

We claim:

1. In a process of manufacturing curved shirt plackets with buttonholes, the improvement comprising moving a curved placket blank from the top of a stacked bundle of the curved placket blanks to a sewing station, intermittently moving the placket blank along its length through the sewing station, sewing and cutting a series of buttonholes in the placket blank at spaced intervals in one-half the length of the placket blank with the lengths of the buttonholes extending across the length of the placket blank, and turning the placket blank with respect to the sewing station to orient the lengths of the buttonholes approximately normal to the length of the curved placket blank.

2. The process of claim 1 and further including the steps of moving the placket blank along its length from the sewing station to a cutting station, holding the placket blank in the cutting station, cutting the placket blank across its length to form a buttonhole half and a button half, moving the halves of the placket from the cutting station.

3. The process of claim 1 and further including the steps of moving the placket blank along its length from the sewing station to a cutting station, cutting the placket blank across its length to form a buttonhole half and a button half, stacking the buttonhole half in a stack of buttonhole halves and stacking the button half in a stack of button halves.

4. The process of claim 1 and wherein the step of moving the curved placket blank from the top of a stacked bundle of curved placket blanks to a sewing station comprises moving a bundle of placket blanks in an upward direction to a predetermined level and then moving the bundle in a downward direction, grasping the top placket blank when the bundle is in its uppermost position, depositing the top placket blank in a positioning station, moving the placket blank at the positioning station in directions across and along the length of the placket blank until the placket blank is properly oriented and positioned for indexing through the sewing station.

5. A method of feeding shirt placket blanks or the like to subsequent work station comprising moving a bundle of vertically stacked placket blanks in an upward direction until the top placket blank reaches a predetermined height and subsequently moving the bundle in a downward direction, grasping the top placket blank when the bundle in in its uppermost position and supporting the top placket blank so that the subsequent downward movement of the bundle separates the top placket blank from the bundle, moving the top placket blank laterally from above the bundle to a subsequent work station and dropping the placket blank to a positioning platform, pushing the placket blank across its length on the positioning platform to a first intermediate position to orient the placket blank, moving the positioning platform in a direction extending along the length of the placket blank and carrying the placket blank until the leading end of the placket blank reaches a second intermediate position, and pushing the placket blank across its length off the positioning platform.

6. The method of claim 5 and wherein the step of pushing the placket blank across its length off the positioning platform comprises pushing the placket blank onto an indexing tray, and further including the steps of intermittently moving the placket blank along its length and along the indexing tray to a sewing station to form buttonholes in the placket blank, and turning the placket blank with respect to the sewing station to form the buttonholes in different attitudes along the length of the placket blank.

7. In a process of manufacturing placket blanks or the like, the improvement comprises sequentially depositing elongated placket blanks on a positioning platform, pushing each placket blank across its length to a first intermediate position to orient the placket blank, moving the placket blank along its length from the first intermediate position to a second intermediate position, and pushing the placket blank across its length from its second intermediate position to a subsequent work station.

8. The process of claim 7 and wherein the step of moving the placket blank from its first intermediate position to its second intermediate position comprises moving the positioning platform in a direction extending along the length of the placket blank.

9. In a process of manufacturing curved shirt plackets with buttonholes, the improvement comprising intermittently moving a curved placket along its length through a buttonhole sewing station, forming buttonholes in the curved placket with the length of the buttonholes extending across the length of the curved placket, turning the curved placket between the formation of adjacent ones of the buttonholes to maintain the length of the curved placket in proper position with respect to the sewing station.

10. In a process of manufacturing shirt plackets or the like, the steps of pulling a placket along its length at a first speed from a buttonhole sewing machine or the like toward a cutting station, decreasing the speed of the placket as it approaches the position in the cutting station where it is to be cut, simultaneously holding the placket at the cutting station and cutting the placket across its length, and moving the halves of the placket away from the cutting station.

11. The process of claim 10 and wherein the step of simultaneously holding the placket at the cutting station and cutting the placket across its length comprises holding the placket in two places spaced along the length of the placket and cutting the placket between the positions where the placket is held.

* * * * *